United States Patent [19]

Hafner et al.

[11] Patent Number: 4,860,710

[45] Date of Patent: Aug. 29, 1989

[54] FUEL SUPPLY LINE

[75] Inventors: Udo Hafner, Lorch; Heinrich Knapp, Leonberg, both of Fed. Rep. of Germany

[73] Assignee: Robert Bosch GmbH, Stuttgart, Fed. Rep. of Germany

[21] Appl. No.: 227,479

[22] Filed: Aug. 1, 1988

Related U.S. Application Data

[63] Continuation of Ser. No. 643,769, Aug. 24, 1984, abandoned, which is a continuation of Ser. No. 475,787, Mar. 16, 1983, abandoned.

[30] Foreign Application Priority Data

Jul. 30, 1982 [DE] Fed. Rep. of Germany ..... 3228508

[51] Int. Cl.[4] ..... F02M 39/00

[52] U.S. Cl. ..... 123/470; 123/468; 123/469

[58] Field of Search ..... 123/467, 468, 469, 470, 123/471, 472

[56] References Cited

U.S. PATENT DOCUMENTS

| | | | |
|---|---|---|---|
| 3,125,078 | 3/1964 | Reiners | 123/468 |
| 3,605,703 | 9/1971 | Moulds | 123/470 |
| 3,776,209 | 12/1977 | Wertheimer | 123/470 |
| 4,201,172 | 5/1980 | Jaggle et al. | 123/470 |
| 4,235,210 | 11/1980 | Sumiyoshi | 123/470 |
| 4,246,877 | 1/1981 | Kennedy | 123/470 |
| 4,294,215 | 10/1981 | Hans | 123/469 |
| 4,307,693 | 12/1981 | Glockler et al. | 123/469 |
| 4,395,988 | 8/1983 | Knapp | 123/470 |
| 4,416,238 | 11/1983 | Knapp | 123/470 |

FOREIGN PATENT DOCUMENTS

| | | | |
|---|---|---|---|
| 3102853 | 9/1982 | Fed. Rep. of Germany | 123/469 |

*Primary Examiner*—Carl S. Miller

*Attorney, Agent, or Firm*—Edwin E. Greigg

[57] ABSTRACT

A fuel supply line, which serves to supply fuel to a fuel injection system for internal combustion engines. The fuel supply line includes receptacles, in each of which a stepped receiving bore is formed with the bores arranged to surround the injection valve in the axial direction and open both at the mouthpiece and the connection end of the injection valve. The injection valve is held by a holding body with a holding shoulder of the injection valve resting on a holding step of the receiving bore. The receiving bore of the receptacle extends outside the flowthrough cross section of the fuel supply line. A filter element is provided in the flow path of the fuel between the flowthrough cross section and fuel openings at the circumference of the injection valve. The fuel supply line, together with the receptacles, is advantageously manufactured of plastic as an extruded part.

10 Claims, 3 Drawing Sheets

Fig. 3
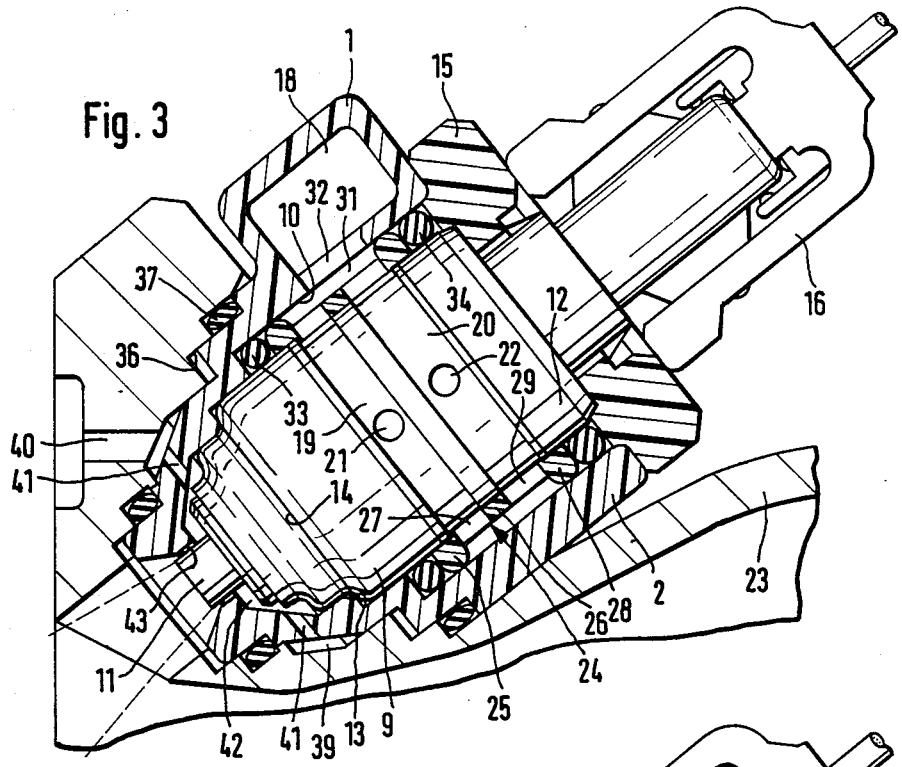
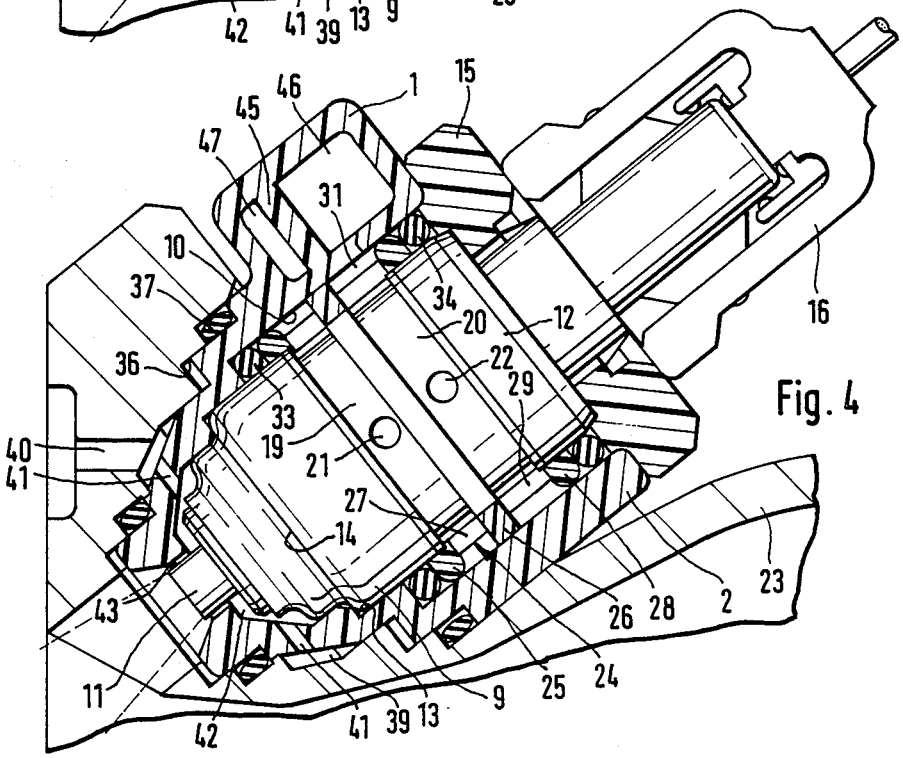
Fig. 4

FUEL SUPPLY LINE

This application is a continuation of Ser. No. 06/643,769, filed 8/24/84, which is a continuation of Ser. No. 06/475,787, filed 3/16/83, both abandoned.

BACKGROUND OF THE INVENTION

This invention is based on a fuel supply line of the general type as disclosed hereinafter. A fuel supply line is already known through which the mouthpieces of injection valves protrude. However, the present structures cause problems in the bearing of the injection valve and offer only limited opportunities for conducting heat away from the valve and for heat-insulating the injection valve.

For those who desire to familiarize themselves with the subject matter involved herein, reference is made to the following pending U.S. patent applications which are of interest and are assigned to the assignee of this application:

| | | | |
|---|---|---|---|
| Romann | Serial No. 397,713 | July 13, 1982 | now abandoned |
| Sauer | Serial No. 415,214 | September 7, 1982 | now U.S. Pat. No. 4,497,443 |
| Hafner et al | Serial No. 397,970 | July 14, 1982 | now U.S. Pat. No. 4,445,828 |

OBJECT AND SUMMARY OF THE INVENTION

The fuel supply line according to the invention has the advantage over the prior art that satisfactory bearing of the injection valve is provided, and good heat conduction and heat insulation are simultaneously attained.

The invention will be better understood and further objects and advantages thereof will become more apparent from the ensuing detailed description of preferred embodiments taken in conjunction with the drawings.

BRIEF DESCRIPTION OF THE DRAWINGS

FIG. 3 shows a fuel supply line in section and having a valve and air preparation; and FIG. 4 is a section taken through a fuel supply line having an inlet cross section and a return-flow cross section.

DESCRIPTION OF THE PREFERRED EMBODIMENTS

Figure 1:
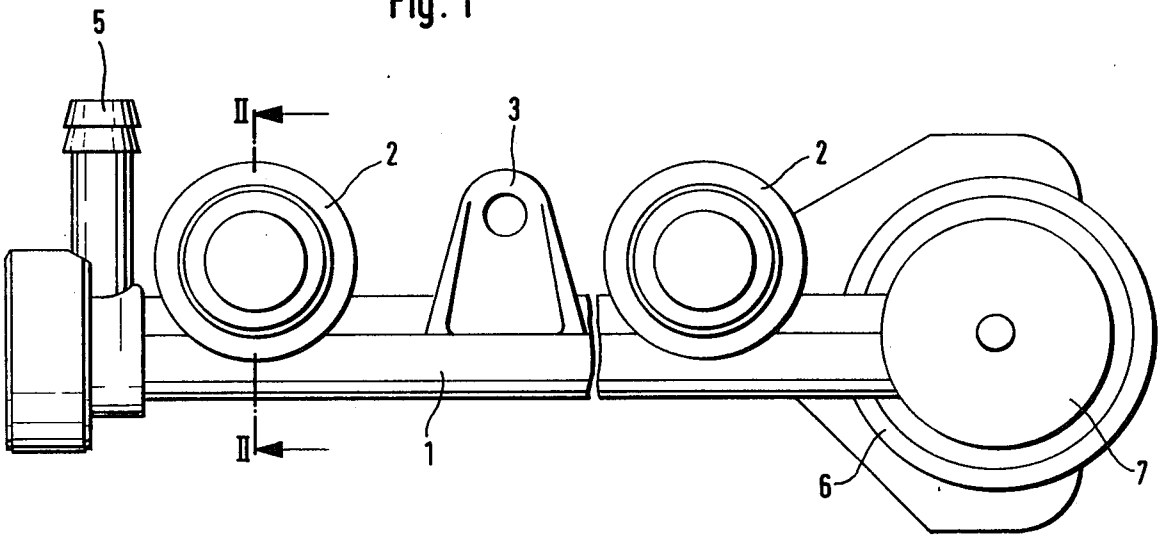
FIG. 1 shows a fuel supply line according to the invention in simplified form.

In FIG. 1, a fuel supply line 1 is shown, which is advantageously embodied as an extruded plastic part. The receptacles 2 are molded onto the fuel supply line 1, and each receptacle serves to hold one fuel injection valve of a fuel injection system. The fuel supply line 1 can be secured on an internal combustion engine via fastening means 3. The fuel supply line 1 communicates via an inlet nipple 5 with a fuel supply source (not shown), for instance a fuel pump which pumps fuel from a fuel container. On the end of the fuel supply line 1 remote from the inlet nipple 5, a receiving flange 6 is provided, in which a pressure regulating valve 7 of a known design is secured, by means of which the fuel pressure upstream of the pressure regulating valve 7 is regulated to a constant pressure, and a partial quantity of fuel is capable of flowing back to the fuel container.

Figure 2:
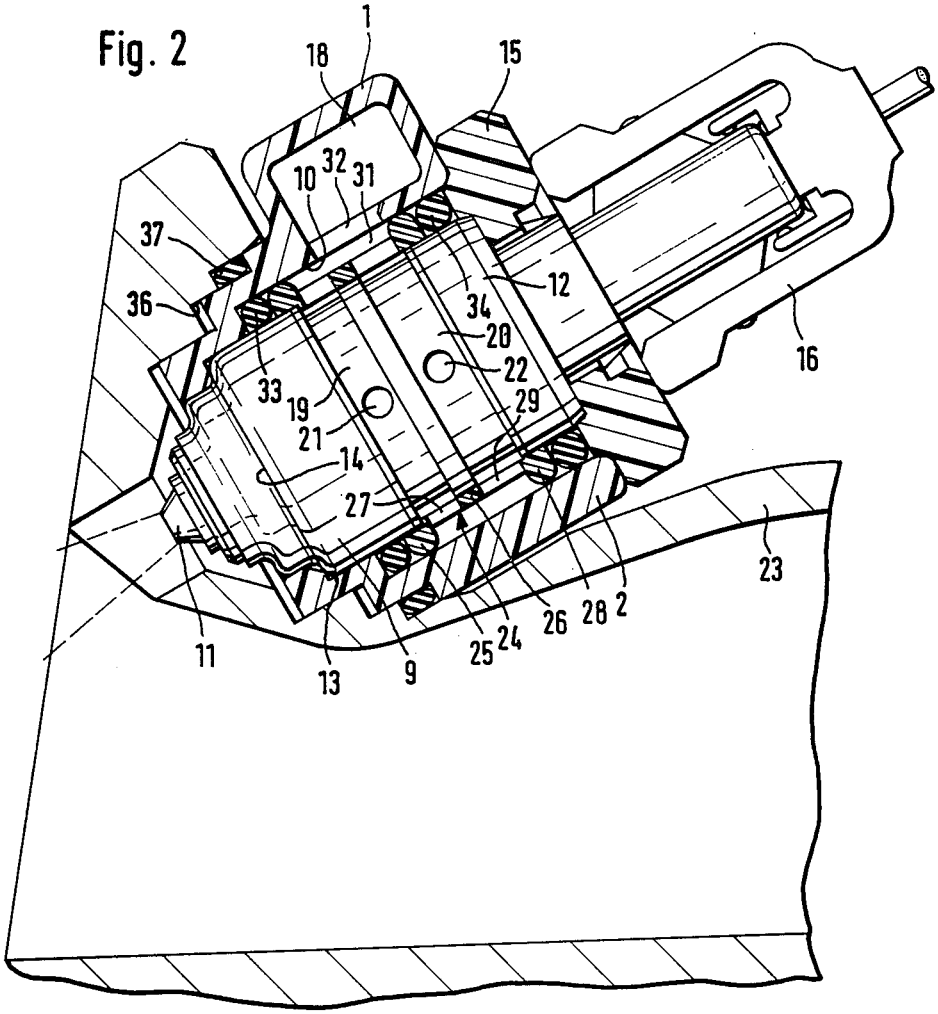
FIG. 2 is a section taken along the line II—II of FIG. 1.

In FIG. 2, a cross sectional view is shown through the fuel supply line 1 and the receptacle 2 along the line II—II of FIG. 1, having a fuel injection valve 9 disposed in the receptacle 2. The receptacle 2 has a stepped receiving bore 10, which surrounds the injection valve 9 in the axial direction and is open toward the mouthpiece 11 and toward the connection end 12 of the injection valve remote from the mouthpiece. The receiving bore 10 has a holder step 13, on which the injection valve 9, resting on a holding shoulder 14, is held by a holding body 15, which engages the connection end 12 of the injection valve 9 and fixes the injection valve 9 in the axial direction. An electrical plug contact 16 engages the connection end 12 of the injection valve 9. The fuel supply line 1 has a flowthrough cross section 18. The receptacles 2 are disposed in such a manner on the fuel supply line 1 that the associated receiving bores 10 extend outside the flowthrough cross section 18. As a result, the extruding tool for fabrication of the fuel supply line can be simpler in its embodiment. Fuel grooves 19 and 20 are provided at the circumference of the injection valve 9, and these grooves are provided with fuel openings 21 and 22 which lead into the interior of the fuel injection valve. The fuel reaching the interior of the fuel injection valve 9 can flow via a valve seat, which is controlled by means of an electromagnetically actuatable valve element, to the mouthpiece 11, by way of which the fuel is injected either into an intake tube 23 or directly into a cylinder of the engine. The injection valve 9 is partially sheathed by a filter element 24, which, while being disposed between a lower carrier ring 25 and a middle carrier ring 26, overlaps the fuel groove 19 with a first filter zone 21 and, between the middle carrier ring 26 and an upper carrier ring 28, overlaps the fuel groove 20 with a second filter zone 29. Remote from the injection valve 9, the lower carrier ring 25 and the upper carrier ring 28 form an annular fuel groove 31 with the inner wall of the receiving bore 10, and this annular fuel groove 31 communicates with the flowthrough cross section 18 of the fuel supply line 1 via an opening 32. For sealing purposes, a sealing ring 33 is disposed near the lower carrier ring 25 and a sealing ring 34 is disposed near the upper carrier ring 28, in each case between the circumference of the injection valve 9 and the receiving bore 10. Each receptacle 2 is advantageously inserted into a stepped bearing bore 36 on the intake tube 23 or on the cylinder of the engine, and a sealing ring 37 between the bearing bore 36 and the receptacle 2 effects sealing with respect to the outside.

The exemplary embodiment shown in FIG. 3 differs from that of FIG. 2 solely in that an annular air groove 39 is embodied in the bearing bore 36 of the intake tube 23 or in the cylinder of the engine; the annular air groove 39 communicates via an air line 40 either with the intake tube upstream of a throttle valve (not shown) or with some other source of air. In the vicinity of the annular air groove 39, air conduits 41 are embodied in the wall of the receptacle 2, leading to an air chamber 42 formed between the receiving bore 10 and the mouthpiece 11. The air for preparing the fuel ejected from the mouthpiece 11 can be directed from the air chamber 42, by means of air guidance conduits 43, onto the ejected fuel stream in such a manner that intensive, thorough mixing takes place. The air guidance conduits 43 may extend either in the axial direction of the injection valve 9 or at an inclination with respect to the valve axis, so that the air which meets the fuel will have had a spin imparted to it.

The exemplary embodiment shown in FIG. 4 differs from the foregoing embodiments solely in that the flow-through cross section of the fuel supply line 1 is divided by a partition 45 into an inlet cross section 46 and a return-flow cross section 47, and the middle carrier ring 26 of the filter element 24 extends from the circumference of the injection valve as far as the receiving bore, so that the fuel grooves 19 and 20 on the injection valve are separated from one another. The fuel supplied via the inlet cross section 46 thus flows via the second filter zone 29 into the fuel groove 20 and through the fuel openings 22 into the interior of the injection valve. Thus, non-metered fuel can flow via the fuel openings 21 out of the interior of the injection valve into the fuel groove 19 and from thee can flow out via the first filter zone 27 to the return-flow cross section 47, from whence it is returned via the pressure regulating valve 7 to the fuel container.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A one piece fuel supply line in combination with a plurality of rigid fuel injection valve receptacles for a fuel injection system for internal combustion engines, said fuel supply line including an inlet at one end, a continuous flow through cross-section along its length and a pressure regulator valve at one of the ends, said plurality of rigid fuel injection valve receptacles are integral with said fuel supply line and spaced in an axial direction along said fuel supply line, each receptacle having a plurality of annular inner and outer surface steps of different cross-sectional dimension to form a stepped receiving bore (10) of predetermined shape offset with respect to said flow through cross-section and embodied such that each of said receptacles is insertable tightly into one each of a plurality of bearing bores (36) in an air intake tube (23), said stepped bearing bore of each receptacle being open on each end and arranged to receive one each of a plurality of injection valves (9), each of said fuel injection valves are provided with fuel openings in the circumference thereof transverse to the axis of the fuel injection valve, an opening (32) from said flow through cross-section to each of said plurality of rigid fuel injection valve receptacles, said opening extends in a direction transverse to the axis of said fuel supply line and in a direction transverse to the axis of the receptacle, each of said fuel injection valves have a mouthpiece (11) and remote from the mouthpiece a connection end (12) which extends from the receptacle and is engaged by electrical plug contact (16), said stepped receiving bore of each of said receptacles opens toward the mouthpiece and toward the connection end of each fuel injection valve with each annular inner step of each receptacle having a greater diameter toward said connection end of said stepped bore, said opening (32) from said flow through cross-section to said stepped bore arranged to permit fuel flow from the supply line directly to one side of said fuel injection valve perpendicular to the axis of the fuel injection valve, each of said fuel injection valves are stepped to conform with each step of said stepped bore of each rigid fuel injection receptacle, each fuel injection valve further including a shoulder portion which is received in a holding step in said stepped bore, means mounted on said fuel injection valve to secure said fuel injection valve in said receptacle, and means on said fuel supply line for securing said fuel supply line onto said engine.

2. A fuel supply line as defined by claim 1, in which filter means encompassing said fuel injection valve is arranged to cover said openings and said fuel flows from said flow through cross-section to said fuel openings through said filter means.

3. A fuel supply line as defined in claim 1, wherein said flow through cross-section of said fuel supply line is divided by a partition, to form a fuel supply feed corresponding to a fuel inlet in said fuel injection valve and to form a fuel return-flow cross-section.

4. A fuel supply line as defined in claim 1, wherein each said fuel injection valve receptacle is insertable in a sealing manner into a bore on an intake tube of said engine.

5. A fuel supply line as defined in claim 1, wherein each said fuel injection valve receptacle is insertable in a sealing manner into a bore in said engine to a cylinder.

6. A fuel supply line as defined in claim 1, wherein air conduits are arranged to discharge into said stepped bores, by way of which preparation air can be supplied to the fuel ejected at said mouthpiece of said fuel injection valve.

7. A fuel supply line as defined in claim 1, wherein said fuel supply line having said fuel injection valve receptacles is fabricated of plastic with said fuel injection valve receptacles molded integral with said fuel supply line.

8. A fuel supply line as defined in claim 3, wherein said fuel return-flow cross-section corresponds to a fuel outlet in said fuel injection valve.

9. A fuel supply line as defined in claim 3, wherein said fuel inflow line (46) is substantially larger in cross-section than said fuel return line (47).

10. A fuel supply line as defined in claim 8, wherein said fuel inflow line (46) is substantially larger in cross-section than said fuel return line (47).

* * * * *